US007699107B2

(12) United States Patent
Butler et al.

(10) Patent No.: US 7,699,107 B2
(45) Date of Patent: Apr. 20, 2010

(54) MECHANICAL AND FLUID JET DRILLING METHOD AND APPARATUS

(75) Inventors: Tom Butler, Enumclaw, WA (US); Daniel Alberts, Maple Valley, WA (US); Jeff Honekamp, Tomball, TX (US); Martin Craighead, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/811,838

(22) Filed: Jun. 12, 2007

(65) Prior Publication Data

US 2008/0000694 A1 Jan. 3, 2008

Related U.S. Application Data

(63) Continuation-in-part of application No. 11/323,683, filed on Dec. 30, 2005.

(51) Int. Cl.

| | |
|---|---|
| ***E21B 43/26*** | (2006.01) |
| ***E21B 21/00*** | (2006.01) |
| ***E21B 7/04*** | (2006.01) |
| ***E21B 7/08*** | (2006.01) |

(52) U.S. Cl. ..... 166/308.1; 166/222; 166/298; 175/78; 175/82

(58) Field of Classification Search ..... 175/67, 175/422, 78, 82; 166/298, 222; 299/17
See application file for complete search history.

(56) References Cited

U.S. PATENT DOCUMENTS

| | | | | |
|---|---|---|---|---|
| 2,397,070 | A | | 3/1946 | Zublin |
| 2,778,603 | A | | 1/1957 | McCune et al. |
| 3,640,344 | A | | 2/1972 | Brandon |
| 3,958,649 | A | | 5/1976 | Bull et al. |
| 4,047,581 | A | | 9/1977 | Erickson |
| 4,106,577 | A | | 8/1978 | Summers |
| 4,119,160 | A | | 10/1978 | Summers et al. |
| 4,226,288 | A | | 10/1980 | Collins, Jr. |
| 4,306,627 | A | | 12/1981 | Cheung et al. |
| 4,317,492 | A | | 3/1982 | Summers et al. |
| 4,343,369 | A | | 8/1982 | Lyons et al. |
| 4,369,850 | A | | 1/1983 | Barker |
| 4,478,295 | A | | 10/1984 | Evans |
| 4,497,381 | A | * | 2/1985 | Dickinson et al. ..... 175/61 |

(Continued)

OTHER PUBLICATIONS

William C. Maurer & Joe K. Heilhecker, Hydraulic Jet Drilling, Society of Petroleum Engineers of AIME, Paper No. SPE 2434, 1969, pp. 213-224.

(Continued)

*Primary Examiner*—David J Bagnell
*Assistant Examiner*—Cathleen R Hutchins
(74) *Attorney, Agent, or Firm*—Bracewell & Giuliani LLP

(57) ABSTRACT

A device useful for conducting lateral or transverse excavating operations within a wellbore comprising a rotating drill bit with jet nozzles on a flexible arm. The arm can retract within the housing of the device during deployment within the wellbore, and can be extended from within the housing in order to conduct excavation operations. A fluid pressure source for providing ultra high pressure to the jet nozzles can be included with the device within the wellbore. The device includes a launch mechanism that supports the arm during the extended position and a positioning gear to aid during the extension and retraction phases of operation of the device.

5 Claims, 4 Drawing Sheets

U.S. PATENT DOCUMENTS

| | | | | |
|---|---|---|---|---|
| 4,518,048 | A | 5/1985 | Varley | |
| 4,534,427 | A | 8/1985 | Wang et al. | |
| 4,624,327 | A | 11/1986 | Reichman | |
| 4,787,465 | A | 11/1988 | Dickinson, III et al. | |
| 4,991,667 | A | 2/1991 | Wilkes, Jr. et al. | |
| 5,246,080 | A | 9/1993 | Horvei et al. | |
| 5,255,750 | A | 10/1993 | Wilkes, Jr. et al. | |
| 5,402,855 | A | 4/1995 | Gondouin | |
| 5,439,066 | A | 8/1995 | Gipson | |
| 5,553,680 | A | 9/1996 | Hathaway | |
| 5,632,604 | A | 5/1997 | Poothodiyil | |
| 5,687,806 | A | 11/1997 | Sallwasser et al. | |
| 5,699,866 | A | 12/1997 | Cousins et al. | |
| 5,771,984 | A | 6/1998 | Potter et al. | |
| 5,853,056 | A | 12/1998 | Landers | |
| 5,879,057 | A | 3/1999 | Schwoebel et al. | |
| 5,911,283 | A | 6/1999 | Cousins et al. | |
| 5,934,390 | A | 8/1999 | Uthe | |
| 5,944,123 | A | 8/1999 | Johnson | |
| 6,125,949 | A | 10/2000 | Landers | |
| 6,142,246 | A | 11/2000 | Dickinson, III et al. | |
| 6,167,968 | B1 | 1/2001 | Allarie et al. | |
| 6,189,629 | B1 | 2/2001 | McLeod et al. | |
| 6,206,112 | B1 | 3/2001 | Dickinson, III et al. | |
| 6,263,984 | B1 | 7/2001 | Buckman, Sr. | |
| 6,289,998 | B1 * | 9/2001 | Krueger et al. | 175/25 |
| 6,470,978 | B2 | 10/2002 | Trueman et al. | |
| 6,510,907 | B1 | 1/2003 | Blange | |
| 6,578,636 | B2 | 6/2003 | Mazorow et al. | |
| 2002/0011357 | A1 | 1/2002 | Trueman et al. | |
| 2002/0023781 | A1 * | 2/2002 | Peters | 175/67 |
| 2002/0062993 | A1 | 5/2002 | Billingsley | |
| 2003/0164253 | A1 | 9/2003 | Trueman et al. | |
| 2003/0213590 | A1 * | 11/2003 | Bakke et al. | 166/55.3 |
| 2005/0279499 | A1 | 12/2005 | Tarvin et al. | |
| 2006/0113114 | A1 * | 6/2006 | Jin et al. | 175/67 |

OTHER PUBLICATIONS

S.E. Forman & G.A. Secor, The Mechanics of Rock Failure Due to Water Jet Impingement, Society of Petroleum Engineers Journal, Paper No. SPE 4247, 1974, pp. 10-18.

K.K. Lafleur & A.K. Johnson, Well Stimulation in the North Sea: A Survey, Society of Petroleum Engineers of AIME, Paper No. SPE 4315, 1973, pp. 1-7.

John C. Fair, Development of High Pressure Abrasive Jet Drilling, Society of Petroleum Engineers of AIME, Paper No. SPE 8442, 1979, pp. 1-12.

Li Kexlang, Present Status and Future Trends of Jet Bit Drilling in China, Society of Petroleum Engineers, Paper No. SPE 14856, 1986, pp. 241-248 and 265-266.

Shen Zhonghou & Sun Qingxiao, A Study on the Pressure Attenuation of Submerged Non-Free Jet and a Method of Calculation for Bottom Hole Hydraulic Parameters, Society of Petroleum Engineers, Paper No. SPE 14869, 1986, pp. 521-524.

T. Butler, P. Fontant & R. Otta, A Method for Combined Jet and Mechanical Drilling, Society of Petroleum Engineers, Paper No. SPE 20460, 1990, pp. 561-565.

T-Y. Hsia & L.A. Behrmann, Perforating Skin as a Function of Rock Permeability and Underbalance, Society of Petroleum Engineers, Paper No. SPE 22810, 1991, pp. 503-510.

L.A. Behrmann, J.K. Pucknell & S.R. Bishop, Effects of Underbalance and Effective Stress on Perforation Damage in Weak Sandstone: Initial Results, Society of Petroleum Engineers, Paper No. SPE 24770, 1992, pp. 81-90.

W.J. Winters, H.B. Mount, P.J. Denitto & M.W. Dykstra, Field Tests of a Low-Cost Lateral Drilling Tool, Society of Petroleum Engineers/IADC, Paper No. SPE/IADC 25748, 1993, pp. 1-17.

Wade Dickinson, H. Dykstra, R. Nordlund, Wayne Dickinson, Coiled-Tubing Radials Placed by Water-Jet Drilling: Field Results, Theory, and Practice, Society of Petroleum Engineers, Paper No. SPE 26348, 1993, pp. 343-355.

A.D. Peters & S.W. Henson, New Well Completion and Stimulation Techniques Using Liquid Jet Cutting Technology, Society of Petroleum Engineers, Paper No. SPE 26583, 1993, pp. 739-745.

M.A. Parker, S. Vitthal, A. Rahimi, J.M. McGowen & W.E. Martch Jr., Hydraulic Fracturing of High-Permeability Formations to Overcome Damage, Society of Petroleum Engineers, Paper No. SPE 27378, 1994, pp. 329-344.

S.D. Veenhuizen, T.A. O'Hanion, D.P. Kelley, J.A. Duda & J.K. Aslakson, Ultra-High Pressure Down Hole Pump for Jet Assisted Drilling, Society of Petroleum Engineers, Paper No. IADC/SPE 35111, 1996, pp. 559-569.

S.D. Veenhuizen, J.J. Koile, C.C. Rice & T.A. O'Hanion, Ultra-High Pressure Jet Assist of Mechanical Drilling, Society of Petroleum Engineers, Paper No. SPE/IADC 37579, 1997, pp. 79-90.

S.D. Veenhuizen, DL.L. Stang, D.P. Kelley, J.R. Duda, & J.K. Aslakson, Development and Testing of Downhole Pump for High-Pressure Jet-Assist Drilling, Society of Petroleum Engineers, Paper No. SPE 38581, 1997, pp. 1-8.

James S. Cobbett, Sand Jet Perforating Revisited, Society of Petroleum Engineers, Paper No. SPE 39597, 1998, pp. 703-715.

P. Buset, M. Riiber & A. Eek, Jet Drilling Tool: Cost-Effective Lateral Drilling Technology for Enhanced Oil Recovery, Society of Petroleum Engineers, Paper No. SPE 68504, 2001, pp. 1-9.

A. Gupta, D.A. Summers, & S.V. Chacko, Feasibility of Fluid-Jet Based Drilling Methods for Drilling Through Unstable Formations, Society of Petroleum Engineers, Paper No. SPE/Petroleum Society of CIM/CHOA 78951, 2002, pp. 1-6.

D.A. Summers & R.L. Henry, Water Jet Cutting of Sedimentary Rock, Journal of Petroleum Technology, Jul. 1972, pp. 797-802.

* cited by examiner

MECHANICAL AND FLUID JET DRILLING METHOD AND APPARATUS

RELATED APPLICATIONS

This application is a continuation-in-part of co-pending U.S. application Ser. No. 11/323,683 filed Dec. 30, 2005, the full disclosure of which is hereby incorporated by reference herein.

BACKGROUND OF THE INVENTION

1. Field of the Invention

The invention relates generally to the field of excavation of subterranean formations. More specifically, the present invention relates to a method and apparatus of excavating using a self-contained system disposable within a wellbore. The present invention involves a method and apparatus for excavating using ultra-high pressure fluids. Though the subject invention has many uses, one of its primary uses is to perforate a well and/or stimulate production in that well.

2. Description of Related Art

Wellbores for use in subterranean extraction of hydrocarbons generally comprise a primary section running in a substantial vertical direction along its length. Secondary wellbores may be formed from the primary wellbore into the subterranean rock formation surrounding the primary wellbore. The secondary wellbores are usually formed to enhance the hydrocarbon production of the primary wellbore and can be excavated just after formation of the primary wellbore. Alternatively, secondary wellbores can be made after the primary wellbore has been in use for some time. Typically the secondary wellbores have a smaller diameter than that of the primary wellbores and are often formed in a substantially horizontal orientation.

In order to excavate a secondary wellbore, numerous devices have been developed for lateral or horizontal drilling within a primary wellbore. Many of these devices include a means for diverting a drill bit from a vertical to a horizontal direction. These means include shoes or whipstocks that are disposed within the wellbore for deflecting the drilling means into the formation surrounding the primary wellbore. Deflecting the drilling means can enable the formation of a secondary wellbore that extends from the primary wellbore into the surrounding formation. Examples of these devices can be found in Buckman, U.S. Pat. No. 6,263,984, McLeod et al., U.S. Pat. No. 6,189,629, Trueman et al., U.S. Pat. No. 6,470,978, Hataway U.S. Pat. No. 5,553,680, Landers, U.S. Pat. No. 6,25,949, Wilkes, Jr. et al., U.S. Pat. No. 5,255,750, McCune et al., U.S. Pat. No. 2,778,603, Bull et al., U.S. Pat. No. 3,958,649, and Johnson, U.S. Pat. No. 5,944,123. One of the drawbacks of utilizing a diverting means within the wellbore however is that the extra step of adding such means within the wellbore can have a significant impact on the expense of such a drilling operation.

Other devices for forming secondary wellbores include mechanical/hydraulic devices for urging a drill bit through well casing, mechanical locators, and a tubing bending apparatus. Examples of these devices can be found in Mazorow et al., U.S. Pat. No. 6,578,636, Gipson, U.S. Pat. No. 5,439,066, Allarie et al., U.S. Pat. No. 6,167,968, and Sallwasser et al., U.S. Pat. No. 5,687,806. Shortcomings of the mechanical drilling devices include the limited dimensions of any secondary wellbores that may be formed with these devices. Drawbacks of excavating devices having mechanical locators and/or tubing bending include the diminished drilling rate capabilities of those devices. Therefore, there exists a need for a device and method for excavating secondary wellbores, where the excavation process can be performed in a single step and without the need for positioning diverting devices within a wellbore previous to excavating. There also exists a need for a device that can efficiently produce secondary wellbores at an acceptable rate of operation.

BRIEF SUMMARY OF THE INVENTION

Disclosed herein is an excavation system comprising, a casing excavation device, a wellbore formation excavation device, and an ultra-high pressure source. The ultra-high pressure source provides fluid pressurized to an ultra-high pressure to the wellbore formation excavation device. Ultra-high pressure fluid can also be provided to the casing excavation device. The casing excavation device may comprise a drill bit, a milling device, a fluted drill bit, or a rotary drill. The casing and the wellbore formation excavation devices may be disposed on an arm that is extendable from the excavation system for excavating contact with a casing and formation.

DETAILED DESCRIPTION OF THE INVENTION

Figure 1:
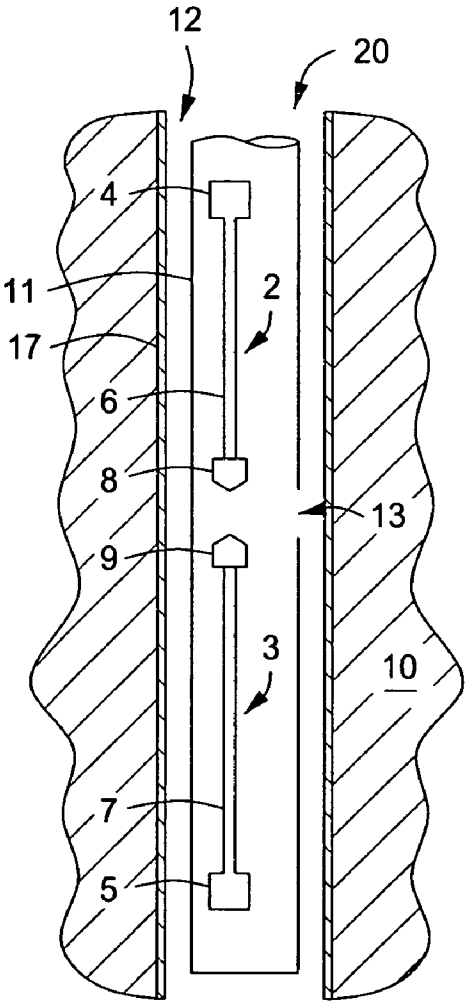
FIG. 1 depicts in partial cross sectional view one embodiment of an excavation system.

The present invention includes a method and apparatus useful for excavating and forming subterranean wellbores, including secondary wellbores extending laterally or transverse from a primary wellbore. With reference to FIG. 1, one embodiment of an excavation system 20 of the present invention is shown disposed within a wellbore 12. The wellbore 12 is formed through a portion of a subterranean formation 10, the outer circumference of the wellbore 12 is lined with casing 17 that separates the wellbore 12 from the formation 10. This embodiment comprises a body 11 housing a first and a second excavation device (2, 3). Each excavation device (2, 3) comprises a drive means (4, 5), a shaft (6, 7) connected on one end to the drive means, and an excavating member (8, 9) disposed on the end of the shaft opposite the drive means (4, 5). An aperture 13 is shown formed on the body 11.

The excavation system 20 may be conveyed into and out of the wellbore 12 by wireline (not shown). The wireline may also provide a command control delivery means to the excavation system for activating, operating, de-activating, or otherwise controlling the excavation system. Other conveyance and delivery means include tubing, coiled tubing, slickline, and drill string.

Figure 2:
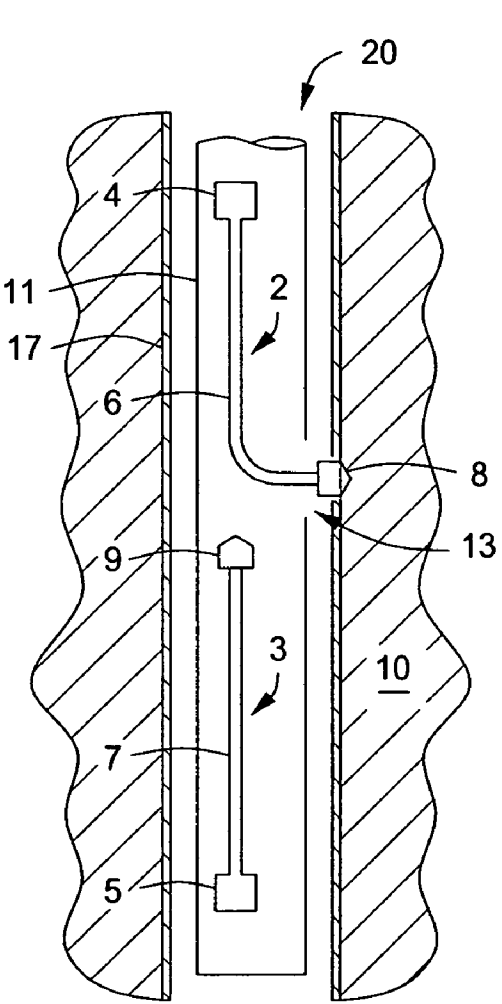
FIG. 2 illustrates in partial cross sectional view an embodiment of an excavation system in an extended position.

In the embodiment of FIG. 2, the first excavation device 2 is shown excavating away a portion of the casing 17. This is accomplished by rotating the excavating member 8 while simultaneously pushing the excavating member 8 against the casing 17. The motive power for both the rotation and pushing of the excavating member 8 may be provided via the drive means 4. Additionally, the force needed to extend the shaft 6 for engaging the excavating member 8 with the casing 17 may also be provided by the drive means 4. The aperture 13 is provided to allow the excavating member 8 to extend from within the body 11 to the casing 17. In the embodiment of FIG. 2, the excavating member 8 is utilized primarily for forming a passageway through a portion of the casing 17. The excavating member 8 may comprise a drill bit, a fluted carbide end mill with radiused edges, a rotary drill bit, diamond encrusted bits, as well as a milling device.

Figure 3:
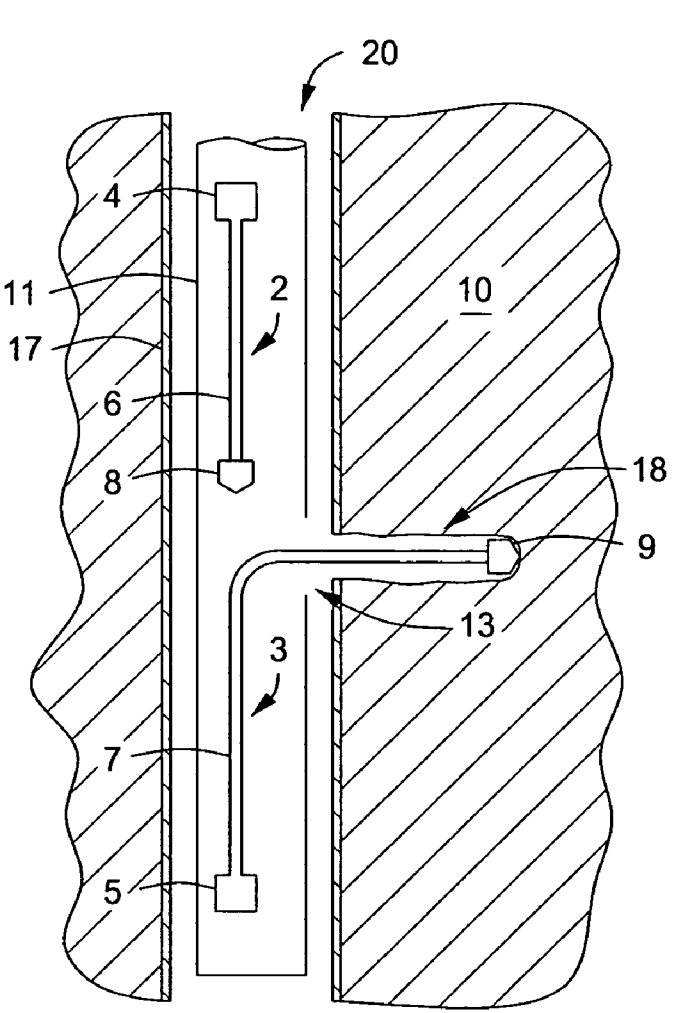
FIG. 3 illustrates in partial cross sectional view an embodiment of an excavation system in an extended position.

With reference now to FIG. 3, the second excavating device 3 is shown excavating a passage 18 that initiates at the wellbore 12 and extends into the surrounding formation 10. Excavation of the passage 18 occurs by pressing the excavating member 9 against the formation 10 while at the same time rotating the excavating member 9. Both the pressing force and rotation of the excavating member 9 may be supplied by the drive means 5. In the embodiment of FIGS. 2 and 3, the excavating member 9 is used primarily for excavating formation material, and not the casing 17. By relegating the excavating member 8 to the removal of casing material and the excavating member 9 to formation excavation, the design and material of these respective members can be chosen to better suit their specific applications. Examples of the excavating member 9 may include a drill bit, a fluted carbide end mill with radiused edges, a rotary drill bit, diamond encrusted bits, as well as a milling device. It should be pointed out however that the second excavating device 3 may be used to remove the casing material and the first excavation device 2 may be used to form the passage 18 through the formation 10. Within the context of this disclosure, excavation includes drilling, milling, punching, piercing, perforating, boring, and any other act of removing material.

The drive means (4, 5) may comprise a motor, such as an electrically powered motor or a mud motor powered by the hydraulic pressure of downhole fluids. The drive means as shown is disposed within the wellbore 12 proximate to the excavation system 20 and directly coupled to the shaft or at the surface. However alternative embodiments exist wherein the drive means is disposed at surface. Optionally, a hydraulic pump as well as an intensifier (not shown) may be included with the excavation system 20 of FIGS. 1-3 for delivering ultra-high pressure fluid to the excavating members (8, 9) to aid in their excavation. In one embodiment the ultra-high pressure fluid travels via a conduit within the shaft to its respective excavating member. During excavation the ultra-high pressure exits through a nozzle formed on or proximate to the cutting tip of the excavating member. Injecting ultra-high pressure fluid onto the material being excavated aids in the excavation process as well as the removal of cutting debris.

Figure 4:
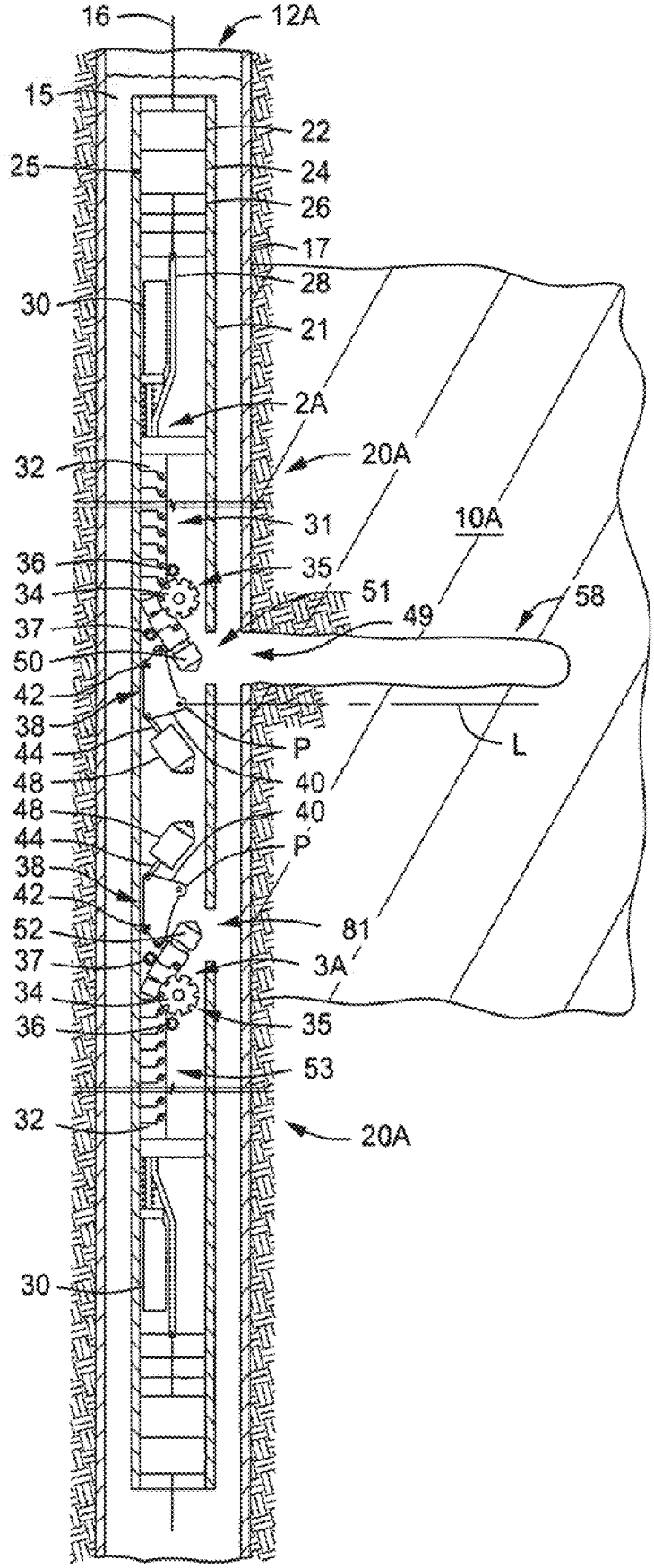
FIG. 4 is a partial cutaway view of a side view of an embodiment of an excavation.

In the embodiment of FIG. 4, the excavation system also comprises a first excavation device 2*a* and a second excavation system 3*a* both disposed within a housing. In this embodiment the excavation device 2*a* comprises a motor 22 in mechanical cooperation with a pressurized fluid source disposed within a housing 21. The pressurized fluid source of FIG. 4 is a pump unit 24. A conduit 28 is shown connected on one end to the discharge of the pump unit 24 and on the other end to an excavating member 50. An optional intensifier 26 is included, that in cooperation with the pump unit 24, increases the pressure of the fluid exiting the pump unit 24. The pump unit 24, either by itself or in combination with the intensifier 26, is capable of pressurizing fluid to ultra-high pressures. For the purposes of this disclosure, ultra-high pressures are those that exceed 1500 pounds per square inch (1.03E7 Pa) above the well bore or hydrostatic pressure. An arm 31 is provided that houses a length of the conduit 28; the arm 31 terminates at the excavating member 50. The conduit 28 provides a fluid flow path from the discharge of the pump unit 24 or optional intensifier 26 to the excavating member 50. The conduit 28 can be comprised of hose, flexible hose, tubing, flexible tubing, ducting, or any other suitable means of conveying a flow of pressurized fluid.

In the embodiment of FIG. 4, the motor 22 is adjacent to the pump unit 24 and an integral part of the excavation system 20*a*. The motor 22 may be an electric motor driven by an electrical source (not shown) located at the surface above the wellbore 12*a*, though the electrical source could also be situated somewhere within the wellbore 12*a*, such as proximate to the motor 22. Alternatively, the electrical source could comprise a battery combined with or adjacent to the motor 22. Types of motors other than electrical, such as a mud motor, can be employed with the present invention. Optionally, the motor 22 could be placed above the surface of the wellbore 12*a* and connected to the pump unit 24 via a crankshaft (not shown). It is well within the capabilities of those skilled in the art to select, design, and implement types of motors that are suitable for use with the present invention.

Figure 7:
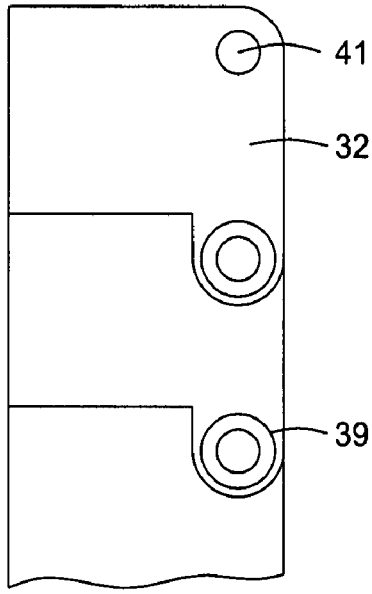
FIG. 7 illustrates a side view of a portion of an arm of an excavation system.

With reference now to the arm 31 of the embodiment of the invention of FIG. 4, it is comprised of a series of generally rectangular segments 32. As seen in FIG. 7, each segment 32 includes a tab 39 (more preferably a pair of tabs 39 disposed on opposite and corresponding sides of the segment 32) extending outward from the rectangular portion of the segment 32 and overlapping a portion of the adjoining segment 32. An aperture 41, capable of receiving a pin 33, is formed through each tab 39 and the portion of the segment 32 that the tab 39 overlaps. Positioning the pin 33 through the aperture 41 secures the tab 39 to the overlapped portion of the adjoining segment 32 and pivotally connects the adjacent segments 32. Strategically positioning the tabs 39 and apertures 41 on the same side of the arm 31 results in an articulated arm 31 that can be flexed by pivoting the individual segments 32. An excavating member 50 is provided on the free end of the arm 31. As will be described in more detail below, flexure of the arm 31 enables the excavating member 50 to be put into a position suitable for excavation. The segments 32 can optionally have non-rectangular cross sectional shapes, such as circular, elliptical, and rhomboidal.

The excavation system 20*a* can be partially or wholly submerged in the fluid 15 of the wellbore 12*a*. The fluid 15 can be any type of liquid, including water, brine, diesel, alcohol, water-based drilling fluids, oil-based drilling fluids, and synthetic drilling fluids. In one embodiment, the fluid 15 is the fluid that already exists within the wellbore 12*a* prior to insertion or operation of the excavating system 20*a*. Accordingly, one of the many advantages of this device is its ability to operate with clean fluid as well as fluid having entrained foreign matter.

In an alternative embodiment, the wellbore 12*a* is filled with an etching acidic solution to accommodate the operation. In such a scenario, the acid used may be any type of acid used for stimulating well production, including hydrofluoric or hydrochloric acid at concentrations of approximately 15% by volume. Though the type of fluid used may vary greatly, those skilled in the art will appreciate that the speed and efficiency of the drilling will depend greatly upon the type and characteristics of the fluid employed. Accordingly, it may be that liquid with a highly polar molecule, such as water or brine, may provide additional drilling advantage.

As previously noted, the excavation device 2*a* of FIG. 4 is at least partially submerged within wellbore fluid 15, the pump unit 24 includes a suction side 25 in fluid communication with the wellbore fluid 15. During operation, the pump unit 24 receives the wellbore fluid 15 through its suction side 25, pressurizes the fluid, and discharges the pressurized fluid into the conduit 28. While the discharge pressure of the pump unit 24 can vary depending on the particular application, the pump unit 24 should be capable of producing pressures sufficient to aid in subterranean excavation by lubricating the excavating member 50 and clearing away cuttings produced during excavation. The pump unit 24 can be comprised of a single fluid pressurizing device or a combination of different fluid pressurizing devices. The fluid pressurizing units that may comprise the pump unit 24 include, an intensifier, centrifugal pumps, swashplate pumps, wobble pumps, a crankshaft pump, and combinations thereof.

Figure 5:
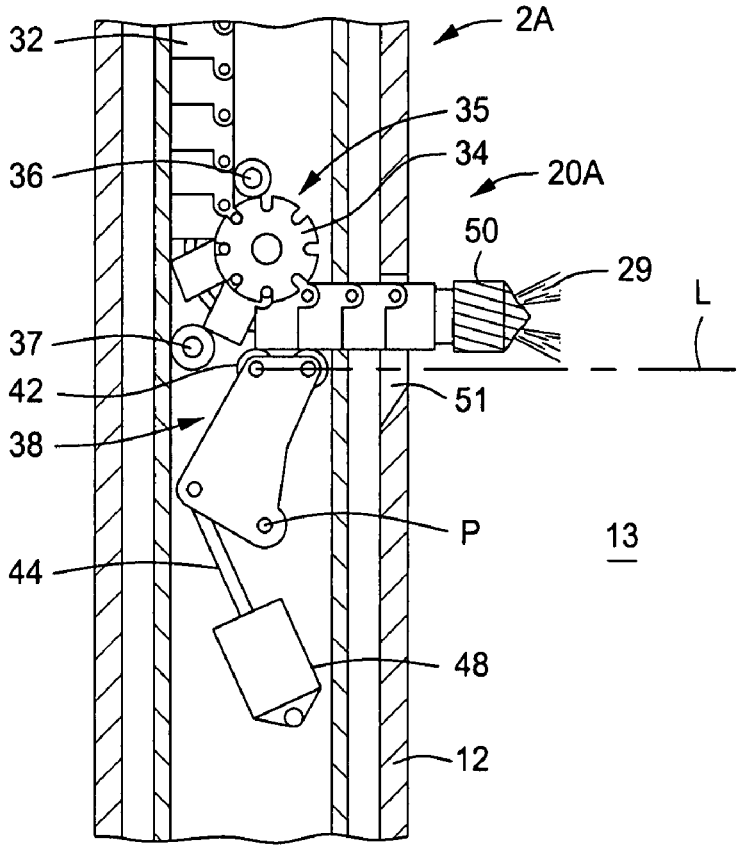
FIG. 5 is a side view of an arm of one embodiment of an excavation system.
Figure 6:
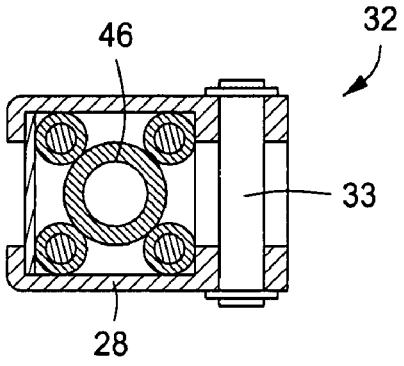
FIG. 6 is a cross sectional view of a portion of an arm of an embodiment of an excavation system.

As with the embodiments of FIGS. 1-3, the first and second excavation devices (2*a*, 3*a*) of the embodiment of FIG. 4 can be used either for the removal of casing material, formation material, or both. The arm 31 of FIG. 4 is shown in a retracted position, launching the arm 31 into the operational mode involves guiding the excavating member 50 first through the aperture 51. An example of an operational mode of the excavation device 2*a* is provided in FIG. 5. The arm 31 may be extended outward such that the excavation member 50 exits the housing 21 into excavating contact with either the casing 17*a* or the subterranean formation 10*a*. A launch mechanism 38 is used to aim the excavating member 50 through the aperture 51. The launch mechanism 38 comprises a base 40 pivotally connected to an actuator 48 by a shaft 44 and also pivotally connected within the housing 21 at pivot point P. Rollers 42 are provided on adjacent corners of the base 40 such that when the arm 31 is in the retracted position a single roller 42 is in contact with the arm 31. Extension of the shaft 44 outward from the actuator 48 pivots the base 40 about pivot point P and puts each roller 42 of the launch mechanism 38 in supporting contact with the arm 31. The presence of the rollers 42 against the arm 31 support and aim the excavating member 50 so that it is substantially aligned in the same direction of a line L connecting the rollers 42.

A positioning mechanism comprising a gear 34 with detents 35 on its outer radius and idler pulleys (36 and 37) is provided to help guide the arm 31 as it is being retracted and extended. The detents 35 receive the pins 33 disposed on each segment 32 and help to track the arm 31 in and out of its respective retraction/extension positions, and the idler pulleys (36 and 37) ease the directional transition of the arm 31 from a substantially vertical position to substantially lateral orientation as the segments 32 pass by the gear 34. Optionally the gear 34 can be motorized such that it can be used to drive the arm 31 into a retracted or extended position utilizing the interaction of the detents 35 and pins 33.

While aiming or directing the drill bit 50 is accomplished by use of the launch mechanism 38, extending the arm 31 from within the housing 21 is typically performed by a drive shaft 46 disposed within the arm 31. The drive shaft 46 is connected on one end to a drill bit driver 30 and on its other end to the drill bit 50. The drill bit driver 30 can impart a translational up and down movement onto the drive shaft 46 that in turn pushes and pulls the excavation member 50 into and out of the housing 21. The drill bit driver 30 also provides a rotating force onto the drive shaft 46 that is transferred by the drive shaft 46 to the excavation member 50. Since the drive shaft 46 is disposed within the arm 31, it must be sufficiently flexible to bend and accommodate the changing configuration of the arm 31. In addition to being flexible, the drive shaft 46 must also possess sufficient stiffness in order to properly transfer the rotational force from the drill bit driver 30 to the excavation member 50.

In operation of the embodiment of FIG. 4, the arm 31 is transferred from the retracted into an extended position by actuation of the launch mechanism 38 combined with extension of the drive shaft 46 by the drill bit driver 30. Before the excavation member 50 contacts the subterranean formation 10 that surrounds the wellbore 12, the motor 22 is activated and the drill bit driver 30 begins to rotate the excavation member 50. As previously noted, activation of the motor 22 in turn drives the pump unit 24 causing it to discharge ultra high pressurized wellbore fluid 15 into the conduit 28 that carries the pressurized fluid onto the excavation member 50. The pressurized fluid exits the excavation member 50 through nozzles (not shown) to form ultra high pressure fluid jets 29. Excavation within the wellbore 12 can be performed with the present invention by urging the excavation member 50 against the subterranean formation 10. The excavation member 50 can be pushed into the formation 10 by activation of the drive shaft 46, by operation of the gear 34, or a combination of both actions. Optionally, if abrasives are included with the fluid, the fluid jets 29 may employed for perforating the casing 17.

Excavation with the present invention is greatly enhanced by combining the fluid jets 29 exiting the excavation member 50 with the rotation of the excavation member 50. The fluid jets 29 lubricate and wash away cuttings produced by the excavation member 50 thereby assisting excavation by the excavation member 50, furthermore the force of the fluid jets 29 erodes away formation 10 itself. Continued erosion of the formation 10 by the present invention forms a lateral or transverse wellbore into the formation 10, where the size and location of the lateral wellbore is adequate to drain the formation 10 of hydrocarbons entrained therein. Similarly, creation of a lateral wellbore transverse to a primary wellbore 12 enables fluids and other substances to be injected into the formation 10 surrounding the wellbore 12 with the excavation system 20*a* herein described.

As previously discussed, the excavation system 20*a* of FIG. 4 includes a second excavation device 3*a* in addition to a first excavation device 2*a*. As shown, the second excavation device 3*a* is also disposed lower in the housing and roughly along the same axis. However other embodiments exist where the second excavation device 3*a* resides in the housing above the first excavation device 2*a*.

The second excavation device 3*a* has many of the same components as the first excavation device 2*a* and accordingly operates in largely the same fashion. Thus for the sake of brevity the elements of the excavation device 3*a* have been assigned the same reference numbers as the corresponding elements of the second excavation device 2*a*. However, for clarity the excavating member 52 and the aperture 81 of the second excavating device 3*a* have different reference numbers from those of the first excavating device 2*a*.

EXAMPLE

One example of operation of the excavation system 20*a* of FIG. 4 comprises activating the first activation device 2*a* in the manner above described thereby extending its arm 31 (and its excavating member 50) into contact with the casing 17*a* and boring a passageway through the casing 17*a*. After forming the passageway through the casing 17*a*, the arm 31 is retracted back into the housing 21. The excavation system

20*a* is repositioned within the wellbore 12*a* to align the aperture 81 (of the second excavation device 3*a*) with the passageway formed by the excavating member 50 of the first excavating device 2*a*. The second excavation device 3*a* is then activated thereby urging its respective arm 53 through the aperture 81, through the passageway 49 and into excavating contact with the formation 10*a* for creating a passage 58 into the formation 10*a*. In this example the function of boring through the casing 17*a* is accomplished by the excavating member 50 of the first excavating device 2*a*, thus the material and design of the excavating member 50 should be suitable for the removal of the material used to form the casing 17*a*. Similarly, since in this example the excavating member 52 of the second excavation device 3*a* creates the passage 58 in the formation 10*a*; the material and design of the excavating member 52 should be suitable for boring through formation material. The excavating members (50, 52) may comprise a drill bit, a fluted carbide end mill with radiused edges, a rotary drill bit, diamond encrusted bits, as well as a milling device.

Repositioning the excavation system 20*a* within the wellbore 12*a* can be accomplished by raising the entire system, such as by reeling in the wireline 16 an amount roughly equal to the distance between the apertures (51, 81). Alternatively, the excavation devices (2*a*, 3*a*) could be configured for axial movement within the housing 21 thus providing for alignment of the aperture 81 to the passageway 49. It is within the capabilities of those skilled in the art to create a method and mechanism for repositioning the excavation devices (2*a*, 3*a*) within the housing 21.

One of the advantages of the present invention is the ability to generate fluid pressure differentials downhole within a wellbore 12 thereby eliminating the need for surface-located pumping devices and their associated downhole piping. Eliminating the need for a surface mounted pumping system along with its associated connections further provides for a safer operation, as any failures during operation will not endanger life or the assets at the surface. Furthermore, positioning the pressure source proximate to where the fluid jets 29 are formed greatly reduces dynamic pressure losses that occur when pumping fluids downhole. Additionally, disposing the pressure source within the wellbore 12 eliminates the need for costly pressure piping to carry pressurized fluid from the surface to where it is discharged for use in excavation.

Although the embodiments shown herein illustrate an excavation member disposed substantially perpendicular to the remaining portion of its associated excavation system, the particular excavation member can be at any angle. Thus the devices disclosed herein are not limited to producing lateral excavations extending perpendicular to a primary wellbore, but can also produce wellbores extending laterally from a deviated or horizontal wellbore.

Figure 8:
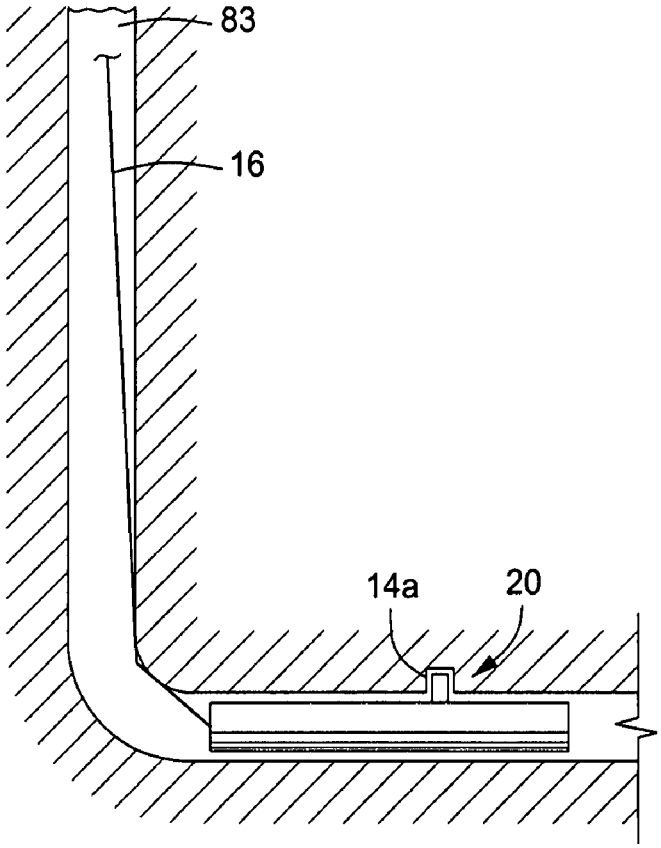
FIG. 8 depicts an embodiment of an excavation system in a deviated portion of a wellbore.
Figure 9:
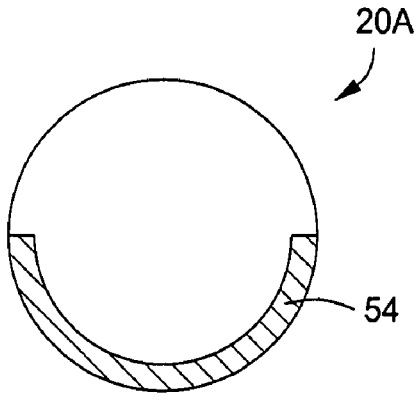
FIG. 9 is a cross sectional view of an embodiment of an excavation system having an orientation system.

In some instances it may be desirable to azimuthally orient the excavation system 20*a* prior to the step of excavation; this applies to the vertical wellbore 12 of FIGS. 1-3 and the deviated wellbore 83 of FIG. 8. Accordingly, an alternative orientation system 54 may be included with the excavation system 20*a* disclosed herein. With reference now to FIG. 9, one embodiment of an orientation system 54 is shown. Here the orientation system 54 comprises at least one weight asymmetrically disposed along a portion of the outer radius of the excavation system 20*a*. However the orientation system 54 considered for use herein can include any device used to azimuthally orient a tool within a wellbore. For example, while the orientation system 54 disclosed herein employs asymmetrically loaded weights, other acceptable orientation embodiments include mechanical devices that anchor against the inner radius of a wellbore and rotate the tool within the wellbore until proper orientation of the tool is achieved within the wellbore. The azimuthal orientation may be determined prior to inserting the excavation system 20*a* within the wellbore 12 (or 83), or may be determined after downhole operations have initiated. One way in which the desired tool orientation may be determined during use is with reference to logging data obtained contemporaneously with the excavation device 20.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of cased wellbore excavation comprising:

disposing an excavation system within the wellbore, the system comprising a housing, first and second pump units in the housing, a first extendable arm in communication with the first pump unit and extendable from the housing, and a second extendable arm in communication with the second pump unit and extendable from the housing;

forming a passageway through a wellbore casing with the first arm; and excavating through the passageway into a formation around the wellbore casing by rotatingly contacting the formation with the second arm and discharging the ultra-high pressure fluid from the second arm towards the formation.

2. The method of claim 1 wherein the fluid is wellbore fluid.

3. The method of claim 1 wherein the step of forming a passageway through a wellbore casing comprising milling.

4. The method of claim 1, wherein the step of excavating into a formation creates a passage in the formation.

5. The method of claim 4 wherein the passage is disposed substantially perpendicular to the wellbore.

* * * * *